United States Patent [19]

Zucker

[11] Patent Number: 4,502,812

[45] Date of Patent: Mar. 5, 1985

[54] ROADWAY BARRIER AND RESTRAINING CAP COMBINATION

[76] Inventor: Stanley Zucker, 15 Mary Beth Dr., Suffern, N.Y. 10901

[21] Appl. No.: 423,656

[22] Filed: Sep. 27, 1982

[51] Int. Cl.[3] ..... E01F 15/00

[52] U.S. Cl. ..... 404/6; 256/13.1; 52/300

[58] Field of Search ..... 404/6, 7, 8, 9, 12, 404/13, 14; 256/13.1, 19; 52/102, 300, 730; 405/284, 286

[56] References Cited

U.S. PATENT DOCUMENTS

| | | | |
|---|---|---|---|
| 35,760 | 2/1902 | Harrison . | |
| 1,921,129 | 8/1933 | Miller . | |
| 2,246,615 | 6/1941 | Bowne | 52/300 X |
| 2,855,776 | 10/1958 | Trostle | 52/300 X |
| 3,288,440 | 11/1966 | Schimmelpenninck . | |
| 3,308,724 | 3/1967 | Smith . | |
| 3,332,666 | 2/1965 | Gray . | |
| 3,428,299 | 2/1969 | Mogensen . | |
| 3,602,109 | 8/1971 | Harrington . | |
| 3,678,815 | 7/1972 | Younker . | |
| 3,822,863 | 7/1974 | Bidwell | 256/13.1 |
| 4,105,353 | 8/1978 | Bórk et al. | 404/6 X |
| 4,190,380 | 2/1980 | Almér et al. | 404/6 |
| 4,249,832 | 1/1981 | Schmanski . | |
| 4,260,296 | 4/1981 | Hilfiker | 404/7 X |
| 4,307,973 | 12/1981 | Glaesener . | |
| 4,376,594 | 3/1983 | Prosenz | 404/6 |
| 4,406,563 | 9/1983 | Urlberger | 404/6 |

*Primary Examiner*—Stephen J. Novosad
*Assistant Examiner*—Beverly E. Hjorth
*Attorney, Agent, or Firm*—Lee C. Robinson, Jr.

[57] ABSTRACT

A restraining cap is provided on the top of a New Jersey type roadway barrier to prevent vehicles from vaulting the barrier or from rolling. The cap can favorably be formed of a continuous series of channel sections with a horizontal web and depending flanges. In a favorable embodiment, the web extends three inches beyond the vertical edge of the barrier, and the flanges extend downward three inches. The sections can be bolted to the barrier top, and can be easily replaced when damaged.

11 Claims, 3 Drawing Figures

FIG. 1
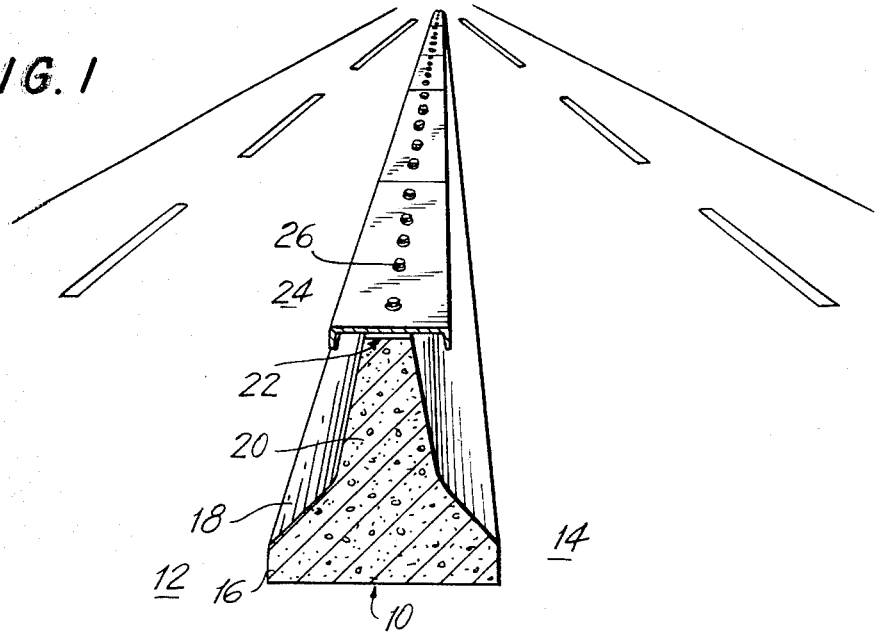
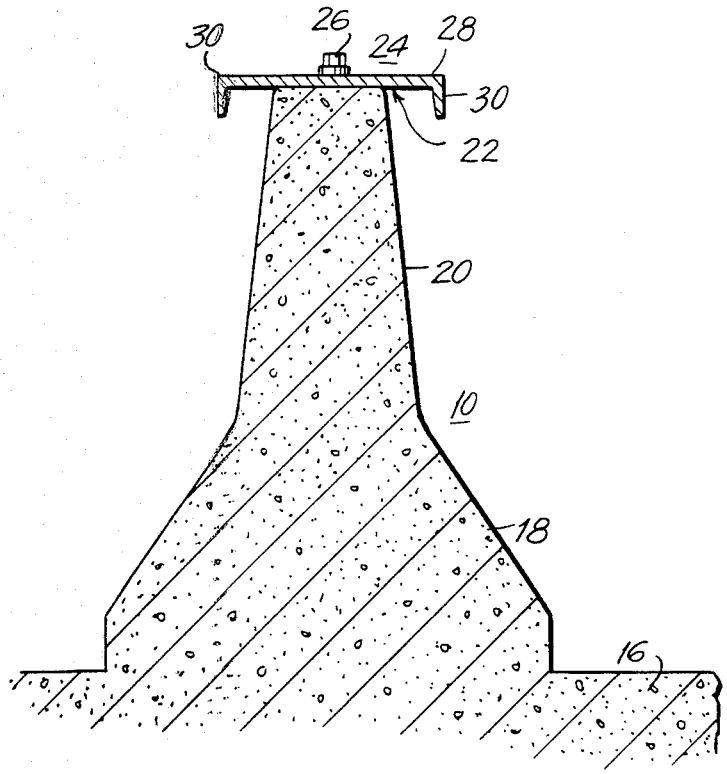
FIG. 2
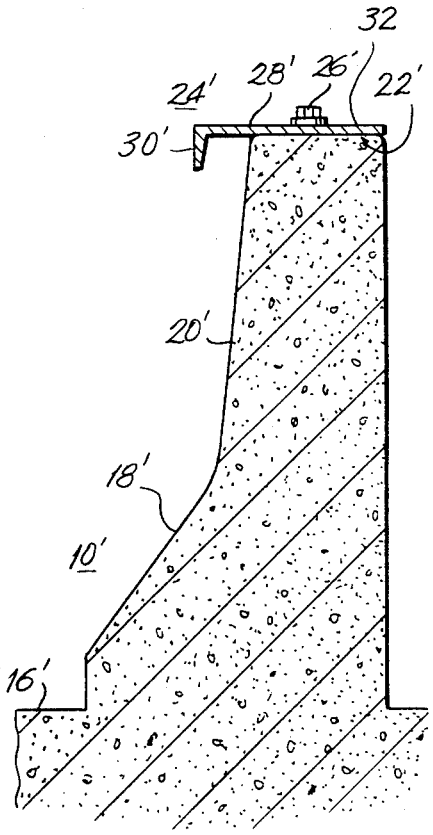
FIG. 3

ROADWAY BARRIER AND RESTRAINING CAP COMBINATION

BACKGROUND OF THE INVENTION

This invention relates to highway safety devices, and is especially directed to New Jersey type roadway barriers, both median (on road) barriers, and shoulder (side-of-road) barriers.

Median barriers are often disposed between opposing lanes of traffic on a divided highway to prevent head-on collisions. A common form of such a median barrier is the well-known New Jersey barrier. These New Jersey barriers are typically precast or poured concrete structures, somewhat bell-shaped in cross-section, and have a wide bottom to resist tipping from impact with an automobile or other vehicle, a flared lower section to engage the tire of a vehicle veering from the roadway into the barrier, and a more-or-less vertical upper section rising to a flattened barrier top. The flared lower section allows the vertical upper section to be set back far enough to provide clearance for the body of the vehicle. Consequently, if a vehicle veers into the New Jersey type barrier at a small angle, the barrier acts to turn the car back onto the roadway to prevent a possible head-on collision with vehicles in the lanes of opposing traffic.

The New Jersey type barrier works well when the traffic is mainly composed of vehicles of standard width and weight. The standard sized vehicles have a relatively wide wheelbase and are relatively heavy. Thus, when a standard size car or truck strikes a New Jersey barrier, the vehicle's tire will slip downward, rather than ride up and over the steep vertical section of the barrier, and the car or truck does not roll (flip over) or vault the barrier.

Recently, there has been a significant increase in the proportion of traffic constituted by smaller compact and subcompact cars. These smaller cars are lighter in weight and have a narrower wheelbase. There is a tendency in these smaller cars, when driven against a New Jersey type barrier, for the wheels to ride up higher onto the barrier. This can results in rolling over or flipping of the vehicle when striking the barrier. If a compact or subcompact car strikes the barrier at certain angles and at higher speeds, the car can completely or partially vault the barrier.

The top of the New Jersey type barrier is generally smooth with no means provided thereon for redirecting the wheel of a vehicle downward and toward the roadway to prevent flipping or rolling of the vehicle, and to prevent the vehicle from vaulting of the barrier.

OBJECTS AND SUMMARY OF THE INVENTION

It is an object of this invention to provide a New Jersey type barrier with a restraining cap to avoid the problems described hereinabove.

It is another object of this invention to provide a New Jersey type barrier in combination with a restraining cap therefor in which portions of the restraining cap which may have been damaged by having been driven into can be easily replaced.

In accordance with several preferred embodiments of this invention, a roadway barrier and restraining cap combination is formed of a New Jersey type roadway barrier and an associated, replaceable restraining cap fastened onto the top of the barrier. The New Jersey type roadway barrier has a lower base portion flared on at least one side thereof facing a roadway, and an upper barrier portion rising from the base portion to a top of the barrier. The substantially continuous surface defined by the flared lower base portion and the substantially vertical upper barrier portion acts, when the roadway barrier is struck by a vehicle veering from the roadway, to encounter a wheel of the vehicle and redirect the vehicle back onto the roadway. The restraining cap fastened onto the top of the barrier extends laterally outward beyond the roadway facing surface at the top of the barrier portion. A hook portion is provided on the outwardly extending portion of the cap to engage and restrain upward motion of a portion of a vehicle whose wheel may be lifted above the flared base portion when the vehicle strikes the barrier to ensure that the vehicle will be returned to the roadway, and will not instead roll over or vault the barrier.

If the roadway barrier is a median barrier, the restraining cap can comprise a channel member with a horizontal web portion extending about three inches outward past the vertical barrier portion, and a flange extending downward approximately three inches to form the hook portion. If, instead, the roadway barrier is a shoulder barrier, the restraining cap can be an L-shaped member with a horizontal web connected by bolts to the top of the barrier and with a flange extending downward on the roadway side of the barrier.

The restraining can be formed of any material of sufficient strength, for example, galvanized steel. However, prefabricated precast concrete, plastics, or fiberglass can be used instead for the restraining cap.

It is also preferred that the restraining cap be formed as a substantially continuous series of sections bolted or otherwise removable fastened to the top of the New Jersey type barrier. This arrangement permits sections which may have been damaged by traffic to be rapidly replaced with other similar sections.

The above, and other objects, features, and advantages of this invention will become apparent from the ensuing description, when considered in connection with the accompanying drawings.

BRIEF DESCRIPTION OF THE DRAWINGS

FIG. 1 is a perspective view along a median barrier having a restraining cap mounted thereon.

FIG. 2 is an elevational section of the median barrier of FIG. 1.

FIG. 3 is an elevational section of a New Jersey type shoulder barrier with a restraining cap mounted thereon.

DETAILED DESCRIPTION OF THE PREFERRED EMBODIMENTS

With reference to the drawings, and initially to FIGS. 1 and 2 thereof, a New Jersey type median barrier or barricade 10 is shown on a divided roadway separating the latter into an oncoming traffic lane 12 and a departing traffic lane 14.

This barrier 10 has a broad foot 16, approximately twenty-four inches across, a flared portion 18 rising and narrowing to a beveled, but nearly vertical upper barrier portion 20, which rises to a substantially flat top 22. This top 22 is at a height of approximately thirty-two inches from the foot 16, and is approximately six inches in width.

Securely fastened to the top 22 of the barrier 10 is a median restraining cap 24, shown in FIG. 1 to be arranged as a substantially continuous series of sections along the top 22 of the barrier 10. The sections of this restraining cap 24 are securely fastened to the barrier 10 by means of bolts 26. However, other fasteners, for example, clamps, could be used instead.

In this embodiment, the restraining cap 24 comprises a channel member formed of galvanized steel. As shown in FIG. 2, the channel member is formed of a horizontal web 28 which extends approximately three inches beyond the edge of the top 22 in the directions of both the oncoming roadway lane 12 and the departing roadway lane 14. Depending flanges 30 extend downwardly a distance of approximately three inches from the lateral edges of the web 28.

Shoulder barrier structure employing the same principles, but adapted to be disposed at the shoulder edge of the roadway lane 12 or 14, is shown in FIG. 3. Here, a New Jersey type shoulder barrier 10' has a flared portion 18', similar to the flared portion 18 of the median barrier 10, on the roadway side of the shoulder barrier 10'. A barrier portion 20' rises from the flared portion 18' to a flat top 22'. In this embodiment, a shoulder barrier restraining cap 24' is an L-shaped member having a horizontal web portion 28' extending approximately three inches beyond the edge of the top 22' and a downwardly directed flange 30' extending approximately three inches downward from the extended edge of the web 28'. The side of the web 28' away from the roadway can end in a stub 32 flush with a back edge of the barrier 10'.

As with the median barrier restraining cap 24, this restraining cap 24' can be formed of galvanized steel or other material of sufficient strength and durability, and can be fastened to the barrier 10' by means of bolts 26.

In either the case of the median barrier 10 and its associated restraining cap 24 or the shoulder barrier 10' and its associated restraining cap 24', the cap 24 or 24' prevents a vehicle which may strike the barrier from riding up over the top 22 or 22' of the barrier. The flange 30 or 30' can engage the tire of the vehicle and redirect it back down to the roadway. This prevents the vehicle from riding up over the top 22 or 22' of the barrier 10 or 10' and also prevents the vehicle from being flipped or rolled over. Moreover, the hook structure defined by the web 28 or 28' and the depending flange 30 or 30' can engage the bumper or body of the vehicle if the wheel should not be stopped by the cap 24 or 24', to prevent the vehicle from vaulting over the barrier 10 or 10' onto the lane 12 of oncoming traffic or off the road onto the shoulder.

Approximately nine inches of horizontal clearance is provided between the flanges 30, 30' and the foot 16 at the bottom of the flared portion 18, 18' of each of the barriers 10, 10'. This is sufficient clearance to prevent damage to the body of the vehicle when its wheels are driven against the barrier 10, 10' at a low angle.

Furthermore, the construction of the restraining caps 24, 24' as a series of similar sections permits any such sections to be rapidly replaced by unbolting any damaged sections and bolting on new sections.

While the preferred embodiments of this invention have been described in detail hereinabove, it should be apparent that the invention is not limited to these embodiments, and many variations and modifications thereof will become apparent to those skilled in the art without departure from the scope and spirit of this invention, as defined in the appended claims.

What is claimed is:

1. Roadway barrier and restraining cap comprising in combination:

a New Jersey type roadway barrier including a base portion flared on at least a side thereof facing a roadway and a barrier portion rising from said base portion to a top of the barrier to define a substantially continuous surface on the roadway-facing side acting when struck by a vehicle veering from the roadway to encounter a wheel of the vehicle and redirect the vehicle back onto the roadway; and a replaceable restraining cap firmly fastened onto the top of the barrier and extending laterally outward beyond the roadway-facing surface at the top of the barrier portion, the restraining cap including substantially vertically-downward depending hook means disposed at a position laterally outward of said roadway-facing surface for restraining upward motion of a portion of a vehicle whose wheel may be lifted above the flared base portion when the vehicle strikes the barrier at a low angle to ensure that the vehicle will be returned to the roadway and does not roll over or vault the barrier.

2. Roadway barrier and restraining cap as recited in claim 1; wherein said restraining cap comprises a channel member having a horizontally-extending web portion and a downwardly directed flange portion on at least the side thereof facing the roadway.

3. Roadway barrier and restraining cap as recited in claim 2; wherein said channel member includes a substantially continuous series of similar channel sections bolted atop the barrier.

4. Roadway median barrier and restraining cap comprising in combination:

a New Jersey type roadway median barrier including a base portion flared on each side and a barrier portion rising from the base portion to a top of the barrier to define substantially continuous surfaces on each side of the barrier to act, when struck by the wheel of a vehicle veering from the roadway, to lift the wheel and redirect the vehicle back onto the roadway; and a restraining cap firmly affixed onto the top of the barrier portion and having hook means extending laterally outward beyond said surfaces at the top of the barrier and then sharply downward to ensure that vehicles striking the flared base portion will be returned to the roadway and do not roll over or vault the barrier.

5. Roadway median barrier and restraining cap as recited in claim 4; wherein said restraining cap comprises a channel member having a horizontal web and downwardly directed flanges disposed at edges of said web.

6. Roadway median barrier and restraining cap as recited in claim 5; wherein said channel member includes a substantially continuous arrangement of channel sections, each section being secured by bolts to the top of the barrier portion so that damage to the restraining cap can be repaired by unbolting and replacing any damaged ones of said sections.

7. Roadway median barrier and restraining cap comprising in combination a New Jersey type roadway median barrier including a base portion flared on each side and a barrier portion rising from the base portion to a top of the barrier to define substantially continuous surfaces on each side of the barrier to act, when struck by the wheel of a vehicle veering from the roadway, to lift the wheel and redirect the vehicle back onto the roadway; and a restraining cap member formed of a channel member extending along the top of the barrier and having a web secured by bolts to the top of the barrier extending laterally beyond each of said surfaces of the barrier portion one predetermined distance to respective projecting edges, and respective flanges extending substantially vertically downward from said projecting edges another predetermined distance, said one and said other predetermined distances being sufficient to ensure restraining engagement with a portion of a vehicle whose wheel may be lifted above the flared base portion when the vehicle strikes the barrier at a low angle.

8. Roadway median barrier and restraining cap as recited in claim 7; wherein said one and said other predetermined distances are substantially three inches and three inches, respectively.

9. Roadway shoulder barrier and restraining cap comprising in combination a New Jersey type roadway shoulder barrier including a base portion flared on one side facing the roadway; and a barrier portion rising from the base portion to a top of the barrier to define a substantially continuous surface on said one side to act, when struck by the wheel of a vehicle veering from the roadway, to lift the wheel and redirect the vehicle back onto the roadway; and a restraining cap firmly affixed onto the top of the barrier portion and having hook means thereon extending laterally beyond the surface of said barrier on said one side at the top of the barrier portion and then extending sharply downward to ensure that vehicles striking the flared base portion will be returned to the roadway, and do not roll over or vault the barrier.

10. Roadway shoulder barrier and restraining cap as recited in claim 9; wherein said restraining cap comprises an L-shaped member extending along the top of the barrier, and having a horizontal web connected by bolts to the top of said barrier and extending one predetermined distance beyond said surface of said barrier portion to a projecting edge of said restraining cap, and a flange extending downward another predetermined distance from said projecting edge.

11. Roadway shoulder barrier and restraining cap as recited in claim 10; wherein said one and said other predetermined distances are substantially three inches and three inches, respectively.

* * * * *